United States Patent [19]

Knorr

[11] 4,453,774

[45] Jun. 12, 1984

[54] DRIVING ARRANGEMENT FOR LONGWALL MINING MACHINES

[75] Inventor: Volker Knorr, Sprockhovel, Fed. Rep. of Germany

[73] Assignee: Gebr. Eickhoff Maschinefabrik und Eisengiesserei m.b.H., Bochum, Fed. Rep. of Germany

[21] Appl. No.: 457,025

[22] Filed: Jan. 10, 1983

[30] Foreign Application Priority Data

Jan. 12, 1982 [DE] Fed. Rep. of Germany ..... 3200565

[51] Int. Cl.[3] ..... E21C 29/22

[52] U.S. Cl. ..... 299/42; 192/12 D; 192/0.076; 192/84 R; 192/84 E

[58] Field of Search ..... 299/42, 43; 192/21, 192/51, 84 R, 84 E, 12 D, 0.076, 48.91, 48.9, 48.2, 48.8, 0.094, 0.048; 310/92, 100

[56] References Cited

U.S. PATENT DOCUMENTS

| | | | |
|---|---|---|---|
| 3,363,732 | 1/1968 | Nakamura et al. | 192/0.094 |
| 3,394,278 | 7/1968 | Schetinin | 310/92 |
| 4,097,091 | 7/1978 | Knorr | 299/43 |
| 4,381,048 | 4/1983 | Haverkamp et al. | 310/92 |

FOREIGN PATENT DOCUMENTS

| | | | |
|---|---|---|---|
| 1168550 | 1/1964 | Fed. Rep. of Germany | 310/92 |
| 2721937 | 11/1978 | Fed. Rep. of Germany | 299/42 |

*Primary Examiner*—William F. Pate, III
*Assistant Examiner*—Mark J. Del Signore
*Attorney, Agent, or Firm*—Thomas H. Murray

[57] ABSTRACT

The invention is particularly adapted for use with a longwall mining machine of the type having a rack extending along a track for the mining machine, a gear wheel on the machine engageable with the rack for moving the machine along a track, at least two shearer drums carried by the machine, at least one driving motor on the machine, and gear train means connecting the driving motor to the shearer drums to rotate the same. Two inductive clutches having a common armature are connected through reduction gearing to the aforesaid driving gear wheel; while separate rotors connect the respective clutches to the gear train such that one rotor will rotate in a direction opposite to the other. A magnetically-actuated, spring-biased friction brake is disposed between the two inductive clutches for braking the clutches when the machine is at rest. The invention provides a self-contained driving unit for both the shearer drums and the driving gear wheel without materially increasing the length of the machine in order that it can be used in thin mineral seams.

6 Claims, 2 Drawing Figures

DRIVING ARRANGEMENT FOR LONGWALL MINING MACHINES

BACKGROUND OF THE INVENTION

Figure 1:
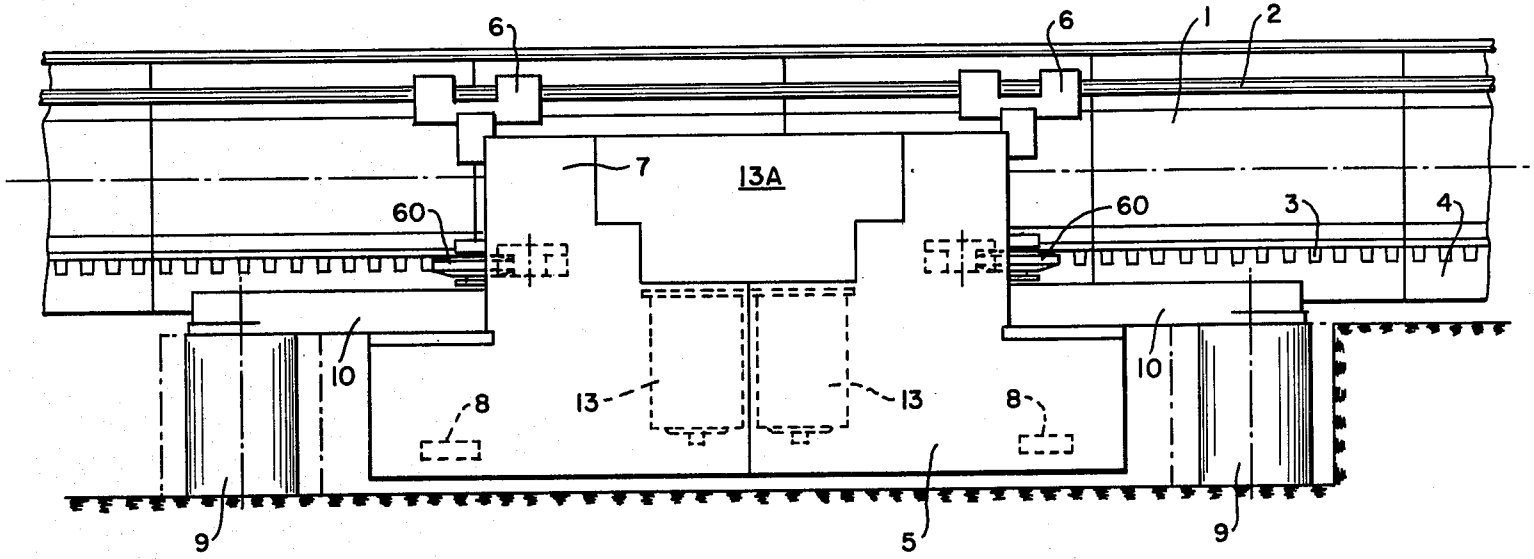

The present invention relates to longwall mining machines, particularly to such machines for working thin seams, in which one or more drive motors are connected through a gear train on one side of the machine to two cutting drums at opposite ends of the machine. The machine is moved along a guide track by a gear wheel which meshes with a rack formed along the track, the rack and gear wheel usually being on the side of the machine opposite the aforesaid gear train.

In the past, longwall mining machines of this type have been provided in which a gear train on one side of the machine drives cutter drums carried on pivotal support arms at opposite ends of the machine. It is also known in the prior art to provide electrical clutches having a direct current energized magnet wheel rotatably mounted in a casing and having a winding around it. The magnet wheel extends around an armature which is disposed on a shaft and is arranged centrally within the magnet wheel. In the event of speed differences between the outer magnet wheel and the inner armature, usually a squirrel-cage armature, the constantly energized magnet wheel has the same effect on the armature as the rotating field of an asynchronous motor. The eddy currents induced in the armature produce in the stationary or slowly rotating armature a driving torque related to excitation and to the slip speed.

Longwall mining machines, even those for working thin seams, are usually provided with self-contained means for moving the machine along its guide track. A self-contained prime mover of this type improves the controllability and maneuverability of the longwall mining machine and has the further substantial advantage of obviating the need for a chain or the like required to transmit pull from a winch which is not carried on the machine itself but rather is disposed at the end of the face being mined. A chain and external winch arrangement is a constant risk to miners working around the machine, hampers access to the face area and does not transmit the pull of the winch at one end of the face area smoothly and continuously to the mining machine. On the other hand, a self-contained driving means in the body of the mining machine takes additional space and increases the overall length of the machine. In this respect, longwall mining machines of substantial overall length are difficult to use in thin, undulating seams since adaptation of the machine body to the seam worsens as the overall length of the machine increases.

SUMMARY OF THE INVENTION

In accordance with the present invention, a new and improved longwall mining machine is provided which incorporates self-contained means for moving it along a guide track but, at the same time, is of reduced overall length facilitating its use in thin seams and the like.

In accordance with the invention, one or more gear wheels which engage a rack extending along a guide track for a longwall mining machine are connected to the aforesaid gear train and prime mover of the mining machine by way of two non-slip-ring type inductive clutches which have a common armature connected to the gear wheel or wheels. Extending around each armature are two rotors, each rotor being connected to an associated gear of the gear train such that one rotor rotates in a direction opposite to that of the other. While the windings of both inductive clutches remain deenergized, no torque is transmitted to the rack-engaging gear wheel of the mining machine. Depending upon the direction of travel of the machine, the winding of one or the other clutch can be energized by a low voltage direct current such that a magnetic field is produced between a rotor and the common armature for both clutches. The rotor, when driven by the prime mover for the machine, now induces eddy currents in the armature by cutting through the lines of force of the magnetic field; and the eddy currents react by producing a magnetic field in the armature and, therefore, a torque which causes it to rotate. Rotation of the armature is then transmitted via reduction gearing to one or more rack-engaging gear wheels to move the machine in the required direction. In this respect, energization of one clutch will cause the machine to move in one direction; whereas energization of the other clutch will cause movement in the other direction. An inductive clutch arrangement of this type takes up much less space than an electrical hydraulic winch. At the same time, the operating voltage is so low that the flameproofing requirements for such clutches are relatively low, thus helping to reduce space requirements. Since the slip speed of such a clutch can be controlled by way of energization of the clutch winding, the rate of advance of the machine can also be controlled in this manner.

In order to secure a longwall mining machine of this type when used in inclined seams and to prevent it from slipping during pauses or in the event of faults, a magnetically-actuated, spring-biased friction brake is provided between the two inductive clutches. When the mining machine is stationary or when faults occur, the brake locks the rack-engaging gear wheels and prevents any movement of the machine due to gravity.

The spring-biased friction brake is engaged in the absence of a magnetic field which acts to release it. Consequently, the brake is actuated only when one of the two inductive clutches is energized but at all other times acts to secure the machine in place.

According to another feature of the invention, and to harmonize the rate of advance of the machine with the loading on the drum cutters, the current drawn by the windings of the two inductive clutches can be made variable in dependence upon the current drawn by the driving motor or motors for the mining machine, thereby insuring that the rate of advance of the machine along the guide track will not be too great for a given loading on the shearer drums.

In one embodiment of the invention, a tachometer generator is operatively connected to the armature of the inductive clutches to produce an output signal proportional to the rate of rotation of the armature. This actual-value signal is compared with a set-value signal determined by the machine operator to vary the direct current passing through one or the other of the clutches which is in operation, so that the machine advances at a constant rate proportional to the preset value, a feature which is necessary for some underground mining operations.

Figure 2:
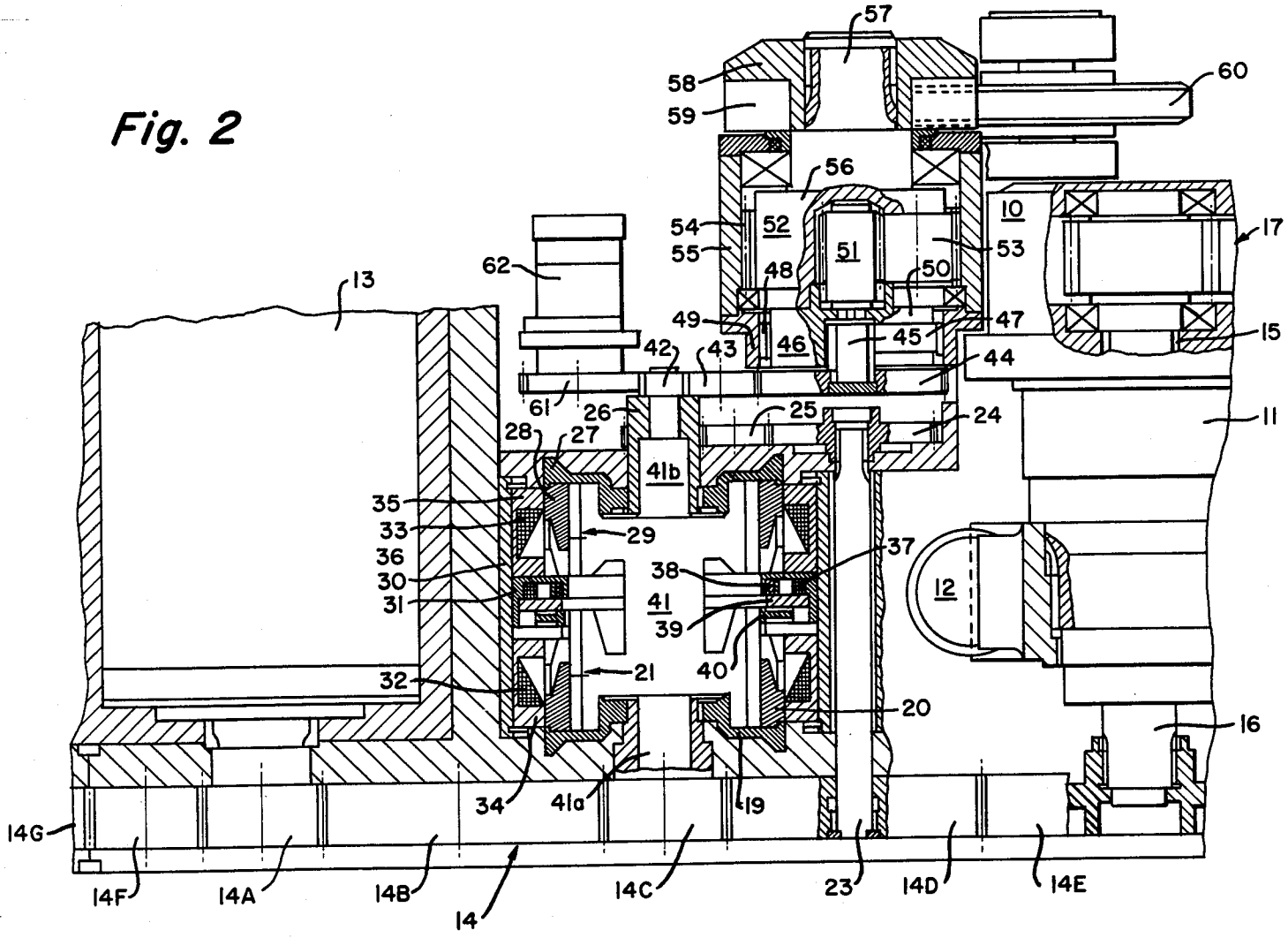

The above and other objects and features of the invention will become apparent from the following detailed description taken in connection with the accompanying drawings which form a part of this specification, and in which:

FIG. 1 is a plan view of a typical longwall mining machine with which the present invention may be employed; and FIG. 2 is a detailed cross-sectional view showing the drive construction of the machine and incorporating the present invention.

With reference now to the drawings, and particularly to FIG. 1, a face conveyor 1 is provided on its stow side with a tubular guide rail 2 and carries on its face side a machine track 4 which has a toothed rack 3 extending along its length. A longwall mining machine 5 runs on the track 4 by means of rollers or sliding runners, not shown, and engages, by means of two guide runners 6 on its portal portion 7, the rail 2 on the stow side of the conveyor. Runners 8 which bear on the mine floor are provided on the machine adjacent the face area and help to support the machine. The machine body is cut free by shearer drums 9 mounted at the forward and trailing ends of the machine body. The cutter drums 9 are mounted on pivotal arms 10 carried on the machine body and disposed above the track 4, as is conventional in longwall miners.

In the embodiment of the invention shown, two drive motors 13 are provided for driving one or more gear wheels 60 which engage the rack 3 to advance the mining machine along the track 4. These same drive motors 13 act to forcibly rotate the cutter drums 9 mounted on arms 10. The drive motors 13 are connected to the cutter drums 9 and gear wheels 60 through a clutch and gear arrangement, generally indicated by the reference numeral 13A in FIG. 1 and shown in detail in FIG. 2.

With specific reference to FIG. 2, only one of the drive motors 13 is shown. It is connected to a gear train 14 including pinion gear 14A and gears 14B, 14C and 14D which mesh with gear 14E connected to a shaft 16. When two motors are used, gear 14A is connected through pinion gears 14F and 14G to a pinion gear for the other driving motor such that both motors drive the entire gear train together.

The shaft 16 is mounted in a bore 15 in pivot shaft 11 mounted on the machine body. This shaft 11 carries one of the two arms 10 for the cutter drums 9. Rotation of the shaft 16 causes rotation of gears in a gear train 17 carried within the arm 10, this latter gear train 17 acting to transmit rotary motion from the shaft 16 to an associated cutter drum 9. The pivot shaft 11 is mounted transversely of the machine body and can be rotated by means of hydraulic cylinders 12 As it rotates, it causes the arm 10 and cutter drum 9 carried thereby to pivot upwardly or downwardly to move the drum into a required operative position.

When the mining machine is operating in a narrow seam, most of the power produced by the two motors 13 is transmitted to the leading drum 9 since this leading drum is, in effect, breaking up the entire seam; whereas the trailing drum either runs idly or simply has to remove a small remainder of the seam.

As well as driving the drums 9, the two motors 13 drive, via gear 14C of the gear train 14, a shaft 41*a* which is connected to a first annular driving member 19 connected to rotor 20 of a first inductive clutch 21. Also, rotation is transmitted via gear 14D of gear train 14 to a shaft 23 which, through gears 24 and 25 at its upper end rotates an externally-toothed sleeve 26. Sleeve 26, in turn, is connected to a second annular drive member 27 connected to the rotor 28 of a second inductive clutch 29, the rotor 28 rotating at the same speed as the rotor 20 but in the opposite direction. The two clutches 21 and 29 are received in coaxially-adjacent relationship in a tubular housing 30 which is immediately adjacent one of the two driving motors 13 and has its axis parallel to the axis of motor 13. A magnetically-actuated, spring-biased friction brake 31 is centered in the sleeve 30 between the clutches 21 and 29. Brake 31 is disposed between annular housings 34 and 35 which extend around inductive clutch windings 32 and 33. The annular housings 34 and 35, in turn, are secured within bore 36 of the tubular housing 30.

The brake 31 includes an annular winding 37 and a number of springs 38 disposed around the periphery of the brake 31. The springs 38 are received within recesses in the brake casing which, like the clutch housings 34 and 35, is secured against rotation in bore 36. An axially-displaceable brake ring 39 is also disposed non-rotatably within the bore 36; while a brake ring 40 having friction linings on its top and bottom sides rotates with and is connected to the common armature 41 of the two clutches 21 and 29. Like the two rotors 20 and 28, the armature 41 is received centrally within the two clutch housings 34 and 35 and the tubular member 30 which extends therearound. The armature 41 is separated from the two rotors 20 and 28. Likewise, the rotors are separated from the housings 34 and 35 around them and their windings 32 and 33 by an air gap. The armature 41 is an element common to the two clutches 21 and 29 and is rotatably mounted by means of shafts 41*a* and 41*b*, shaft 41*a* being connected to gear 14C and shaft 41*b* being connected to sleeve 26.

The armature 41 is connected through gears 42, 43 and 44 to a sungear 45 of a planetary gear arrangement 46. Satellite gears 47 of the planetary gear arrangement roll on internal toothing 48 of a stationary casing 49 and transmit rotation to a satellite carrier 50 coupled to the sungear 51 of a subsequent planetary transmission 52. Sungear 51 meshes with satellite gears 53 of transmission 52 and, by way of internal toothing 54 on casing 55, rotates satellite carrier 56. This latter rotation is transmitted by way of journal 57 of satellite carrier 56 to gear 58. The teeth 59 of gear 58 are engaged by the teeth of the machine driving gear 60 which, therefore, rotates whenever the armature 41 rotates. This rotation is converted, by means of the rack 3 shown in FIG. 1 into rectilinear movement of the mining machine along the track 4.

Meshing with gear 42 on the armature 41 is a gear 61 which drives tachometer generator 62. Generator 62 produces a continual electrical signal which is proportional to the speed of the armature 41 and, therefore, proportional to the speed of the driving gear 60. By comparing this actual-value signal produced by the tachometer generator with a set-point signal determined by the machine operator in a servo loop, the speed of the machine 5 can be adjusted to a required value and, by variation of the direct current energizing the driving clutch, maintained constant. This constant-speed feature can be used for cleaning up runs or at the face ends during sumping-in, when the mining machine advances at reduced speed and jamming of its shearer drums 9 is possible.

The mining machine described, of course, can have just one driving motor 13 driving the gear wheel 60 as well as both of the drums 9. The machine can also be operated by two driving motors 13 which are not interconnected, only one of the two motors driving a single rack-engaging gear wheel 60. It is also possible for the machine to have two driving gear wheels 60, as shown in FIG. 1. In this latter event, each of the two driving gears 60 will be driven by way of two inductive clutches 21 and 29 in the manner hereinbefore described, it being possible for the two motors 13 to be connected via the clutches 21 and 29 either jointly to both of the driving gears 60 or separately to each of them.

The heat dissipated in the clutches 21, 29 when the machine is in operation is removed by a coolant which can be either air or the water used to cool the motor or for dust control. Water is supplied in some suitable way to these parts 21, 29 of the clutches which it is required to cool, and can then be sprayed onto the face area being mined.

Although the invention has been shown in connection with a certain specific embodiment, it will be readily apparent to those skilled in the art that various changes in form and arrangement of parts may be made to suit requirements without departing from the spirit and scope of the invention.

I claim as my invention:

1. In a longwall mining machine of the type having a rack extending along a track for the mining machine, a gear wheel on the machine engageable with the rack for moving the machine along a track, at least one driving motor on the machine, at least two shearer drums carried by the machine, and gear train means connecting said driving motor to said shearer drums to rotate the same; the improvement in said mining machine which comprises two inductive clutches having a common armature connected through reduction gearing to said gear wheel, and separate rotors for the respective clutches connected to said gear train such that one rotor will rotate in a direction opposite to the other.

2. The improvement of claim 1 wherein said inductive clutches are of the non-slip-ring type.

3. The improvement of claim 1 including a magnetically-actuated, spring-biased friction brake between the two inductive clutches for braking said clutches when said machine is at rest.

4. The improvement of claim 3 including actuating windings for the respective inductive clutches and said friction brake, the actuating windings for the clutches being energizable alternately only with each winding being energized only when the winding of the friction brake is deenergized.

5. The improvement of claim 4 characterized in that the current drawn by the actuating windings of the two inductive clutches is varied in dependence on the current drawn by said driving motor.

6. The improvement of claim 5 including a tachometer in driving engagement with the armature of the inductive clutches, said tachometer being adapted to produce an output signal for varying the direct current supplied to the actuating windings of the inductive clutches.

* * * * *